US007813683B2

(12) United States Patent
Furuya et al.

(10) Patent No.: US 7,813,683 B2
(45) Date of Patent: Oct. 12, 2010

(54) BELT DETACHING DEVICE AND IMAGE FORMING APPARATUS INCLUDING BELT DETACHING DEVICE

(75) Inventors: Masaharu Furuya, Kanagawa (JP); Kazuchika Saeki, Kanagawa (JP); Toshitaka Yamaguchi, Kanagawa (JP); Takahiro Nakayama, Kanagawa (JP); Takuya Sekine, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 252 days.

(21) Appl. No.: 11/934,981

(22) Filed: Nov. 5, 2007

(65) Prior Publication Data

US 2008/0112734 A1 May 15, 2008

(30) Foreign Application Priority Data

Nov. 10, 2006 (JP) ..... 2006-305555

(51) Int. Cl.
*G03G 15/01* (2006.01)

(52) U.S. Cl. ..... 399/302

(58) Field of Classification Search ..... 399/121, 399/288, 299, 313, 308
See application file for complete search history.

(56) References Cited

U.S. PATENT DOCUMENTS

| | | | | |
|---|---|---|---|---|
| 5,765,082 | A * | 6/1998 | Numazu et al. | 399/299 |
| 6,201,944 | B1 * | 3/2001 | Onuki et al. | 399/299 |
| 6,336,025 | B1 | 1/2002 | Saeki | |
| 7,277,657 | B2 | 10/2007 | Uchida et al. | |
| 7,277,667 | B2 | 10/2007 | Saito et al. | |
| 2005/0078991 | A1 | 4/2005 | Kimura et al. | |
| 2006/0056884 | A1 | 3/2006 | Sawai et al. | |
| 2006/0210307 | A1 | 9/2006 | Katoh et al. | |
| 2006/0210324 | A1 | 9/2006 | Kuma et al. | |
| 2006/0284958 | A1 | 12/2006 | Saeki et al. | |
| 2006/0285873 | A1 | 12/2006 | Saeki | |
| 2007/0059054 | A1 * | 3/2007 | Furukawa | 399/302 |
| 2007/0098472 | A1 | 5/2007 | Saeki et al. | |
| 2007/0110464 | A1 | 5/2007 | Nakayama et al. | |
| 2007/0127947 | A1 | 6/2007 | Kuma et al. | |
| 2007/0127955 | A1 | 6/2007 | Katoh et al. | |

FOREIGN PATENT DOCUMENTS

| | | | |
|---|---|---|---|
| JP | 2001034082 | A * | 2/2001 |
| JP | 2001-242680 | | 9/2001 |
| JP | 2004-177773 | | 6/2004 |
| JP | 2006-201338 | | 8/2006 |

OTHER PUBLICATIONS

English machine translation of JP2001-034082.*

* cited by examiner

*Primary Examiner*—David M Gray
*Assistant Examiner*—Billy J Lactaoen
(74) *Attorney, Agent, or Firm*—Oblon, Spivak, McClelland, Maier & Neustadt, L.L.P.

(57) ABSTRACT

A belt member faces a plurality of carrying bodies that respectively carry toner images or developers. A plurality of facing members respectively faces the carrying bodies via the belt member. A detaching unit brings at least one of the facing members to face a corresponding carrying body and detaches other facing members from other carrying bodies. A contacting member contacts the belt member to detach the belt member from the other carrying bodies when the detaching unit detaches the other facing members from the other carrying bodies.

18 Claims, 7 Drawing Sheets

BELT DETACHING DEVICE AND IMAGE FORMING APPARATUS INCLUDING BELT DETACHING DEVICE

CROSS-REFERENCE TO RELATED APPLICATIONS

The present application claims priority to and incorporates by reference the entire contents of Japanese priority document, 2006-305555 filed in Japan on Nov. 10, 2006.

BACKGROUND OF THE INVENTION

1. Field of the Invention

The present invention relates to electrophotographic image forming apparatuses, such as copiers, printers, facsimile machines, and multifunction products with functions of these machines, and belt devices provided in the image forming apparatuses. The invention particularly relates to belt devices and image forming apparatuses in which a belt member such as an intermediate transfer belt, a transfer conveyor belt, or a photoreceptor belt performs detaching operation.

2. Description of the Related Art

As seen in conventional copiers, printers, and other image forming apparatuses, tandem-type color image forming apparatuses include an intermediate transfer belt (belt device) (for example, see Japanese Patent Application Laid-Open No. 2001-242680).

Specifically, four photosensitive drums (image carrying bodies) are arranged so as to face an intermediate transfer belt, and carry black, yellow, magenta, and cyan toner images respectively formed thereon. The toner images formed on the photosensitive drums are transferred to and superimposed on the intermediate transfer belt. The multi-color toner image carried on the intermediate transfer belt is transferred to a recording medium as a color image.

Such image forming apparatuses employ technologies that, in forming a black image, a photosensitive drum for black is brought into contact with the intermediate transfer belt so as to detach the other photosensitive drums (for yellow, magenta, and cyan) from the intermediate transfer belt (for example, see Japanese Patent Applications Laid-Open No. 2001-242680 and No. 2006-201338). These technologies attempt to make the drums and the belts to have longer life, prevent scattering of toners, and reduce waste of the toners, for example.

Specifically, Japanese Patent Application Laid-Open No. 2001-242680, for example, discloses a technology that, in forming a black image, one of supporting rollers stretching an intermediate transfer belt is moved so as to detach the intermediate transfer belt from the photosensitive drums for the other three colors.

Japanese Patent Application Laid-Open No. 2006-201338, for example, discloses a technology that, in forming a black image, from among four transfer rollers (primary transfer rollers) facing the four photosensitive drums, three of them exclusive of the one for black are moved by an intermediate transfer belt so as to detach the intermediate transfer belt from the photosensitive drums for the other three colors.

Such conventional image forming apparatuses have difficulties in detaching, when forming a black image, the three image carrying bodies other than the one for black with a sufficient distance from the intermediate transfer belt without increasing their apparatus size.

Specifically, in the image forming apparatus as disclosed in Japanese Patent Application Laid-Open No. 2001-242680, the intermediate transfer belt is detached from the photosensitive drums for the three colors by substantially moving one of the supporting rollers stretching the intermediate transfer belt. This arrangement will secure sufficient space between the three photosensitive drums and the intermediate transfer belt. However, the size of the image forming apparatus is increased because sufficient space is necessary for movement of the intermediate transfer belt.

In the image forming apparatus as disclosed in Japanese Patent Application Laid-Open No. 2006-201338, the intermediate transfer belt is detached from the photosensitive drums for the three colors by moving the three transfer rollers other than the one for black. This arrangement will reduce space inside the intermediate transfer device (or image forming apparatus). However, as the intermediate transfer device becomes smaller, it becomes more difficult to secure sufficient space between the intermediate transfer belt and the three photosensitive drums other than the one for black. Specifically, sufficient space cannot be secured between the photosensitive drum closest to the photosensitive drum for black being in contact with the intermediate transfer belt and its adjacent photosensitive drum, with the result that the both members contact each other. This may cause problems in that the photosensitive drums being close to each other and the intermediate transfer belt become worn, and that toner adhered to the adjacent photosensitive drums scatter over the intermediate transfer belt.

These problems are not limited to the belt devices using an intermediate transfer belt as a belt member, and are commonly seen in those using a transfer conveyor belt or photoreceptor belt as a belt member.

Thus, the belt devices that use a transfer conveyor belt facing the four photosensitive drums (image carrying bodies) have difficulties in detaching, when forming a black image, the three photosensitive drums other than the one for black with sufficient space from the transfer conveyor belt without increasing their apparatus size. The belt devices that use a photoreceptor belt facing the four developing rollers (developer carrying bodies) have difficulties in detaching, when forming a black image, the three developing rollers other than the one for black with sufficient space from the photoreceptor belt without increasing their apparatus size.

SUMMARY OF THE INVENTION

It is an object of the present invention to at least partially solve the problems in the conventional technology.

A belt device according to one aspect of the present invention includes a belt member that faces a plurality of carrying bodies that respectively carry toner images or developers; a plurality of facing members that respectively faces the carrying bodies via the belt member; a detaching unit that brings at least one of the facing members to face a corresponding carrying body and detaches other facing members from other carrying bodies; and a contacting member that contacts the belt member to detach the belt member from the other carrying bodies when the detaching unit detaches the other facing members from the other carrying bodies.

An image forming apparatus according to another aspect of the present invention includes a belt device including a belt member that faces a plurality of carrying bodies that respectively carry toner images or developers, a plurality of facing members that respectively faces the carrying bodies via the belt member, a detaching unit that brings at least one of the facing members to face a corresponding carrying body and detaches other facing members from other carrying bodies, and a contacting member that contacts the belt member to detach the belt member from the other carrying bodies when the detaching unit detaches the other facing members from the other carrying bodies.

An image forming apparatus according to still another aspect of the present invention includes a belt member that faces a plurality of carrying bodies that respectively carry toner images or developers; a plurality of facing members that respectively faces the carrying bodies via the belt member; a detaching unit that brings at least one of the facing members to face a corresponding carrying body and detaches other facing members from other carrying bodies; and a contacting member that contacts the belt member to detach the belt member from the other carrying bodies when the detaching unit detaches the other facing members from the other carrying bodies.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
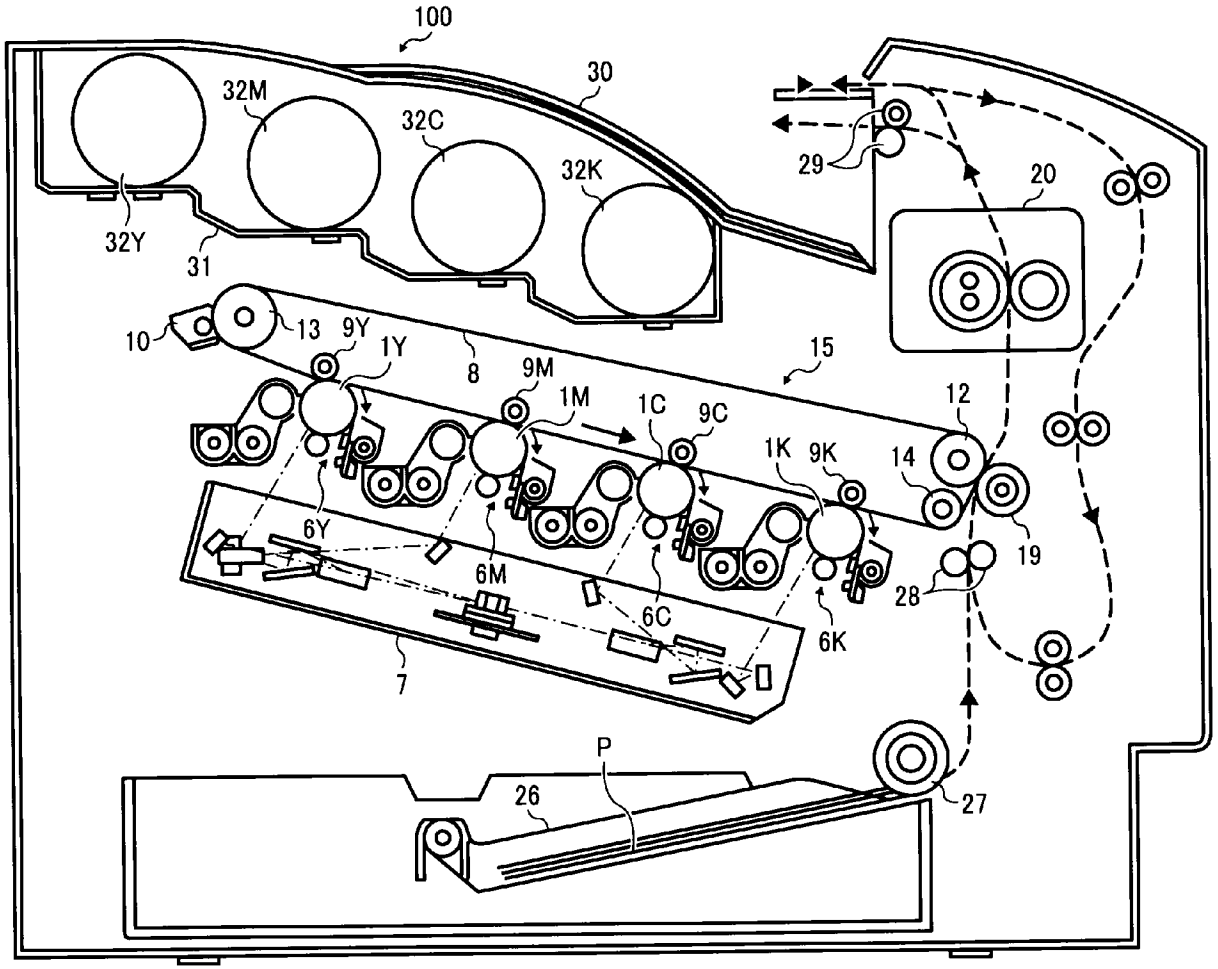
FIG. 1 is a schematic drawing of an overall structure of an image forming apparatus according to a first embodiment of the present invention.

Exemplary embodiments of the present invention are described below in detail with reference to the accompanying drawings. In the drawings, the parts identical or corresponding to each other are indicated by the same reference numerals, and their explanation is simplified or omitted.

Referring to FIGS. 1 to 5, a first embodiment of the present invention is described in detail.

Figure 2:
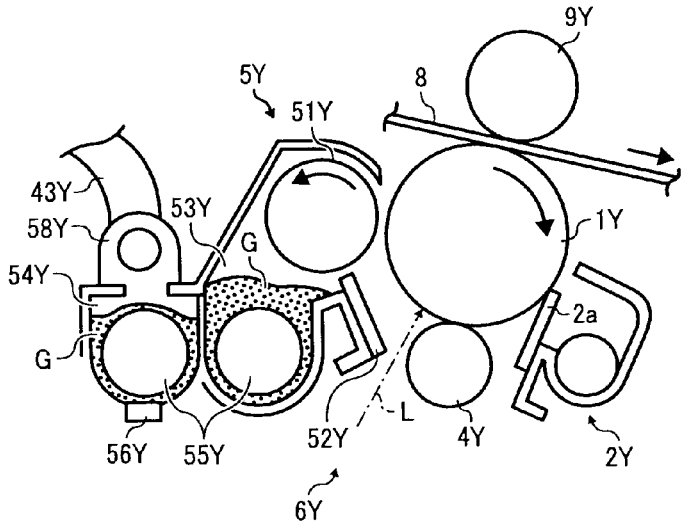
FIG. 2 is a cross-sectional view illustrating an image creating section of the image forming apparatus of FIG. 1.

Referring first to FIGS. 1 and 2, an overall structure and operation of an image forming apparatus is described.

FIG. 1 is a schematic drawing of a printer serving as an image forming apparatus, and FIG. 2 is an enlarged view of its image creating section.

As shown in FIG. 1, an image forming apparatus main body 100 has in its upper portion a bottle container 31, in which four toner bottles 32Y, 32M, 32C, and 32K for yellow, magenta, cyan, and black are detachably provided.

Below the bottle container 31 is provided an intermediate transfer device 15 serving as a belt device. Further, image creating sections 6Y, 6M, 6C, and 6K for yellow, magenta, cyan, and black are arranged so as to face an intermediate transfer belt 8 (belt member) of the intermediate transfer device 15.

As shown in FIG. 2, the yellow image creating section 6Y includes a photosensitive drum 1Y serving as an image carrying body (that carries a toner image), a charger 4Y, a developing unit 5Y, a cleaning unit 2Y, and a de-charger (not shown) that are arranged around the photosensitive drum 1Y. On the photosensitive drum 1Y, image creating processes (charging, exposure, developing, transfer, and cleaning processes) are performed, so as to form a yellow image on the photosensitive drum 1Y.

The other image creating sections 6M, 6C, and 6K have the same structure as the yellow image creating section 6Y, except that toners of different colors are used. With this arrangement, images of the respective toner colors are formed. Hereinafter, explanation for the other three image creating sections 6M, 6C, and 6K is omitted as necessary, and only the yellow image creating section 6Y is explained.

As shown in FIG. 2, the photosensitive drum 1Y is rotatably driven by a driving motor (not shown) in a clockwise direction indicated in FIG. 2. Accordingly, the surface of the photosensitive drum 1Y is uniformly charged at the position of the charger 4Y (charging process).

The surface of the photosensitive drum 1Y then comes to a point where a laser light L emitted from an exposing unit 7 strikes. At this position, the surface is exposed and scanned, and a static latent image to be developed with the yellow toner is formed (exposure process).

The surface of the photosensitive drum 1Y then comes to a point where it faces the developing unit 5Y. At this position, the static latent image is developed and a yellow toner image is formed (developing process).

The surface of the photosensitive drum 1Y then comes to a point where the intermediate transfer belt 8 (belt member) and the transfer roller 9Y (facing member) face each other. At this position, the toner image on the photosensitive drum 1Y is transferred to the intermediate transfer belt 8 (primary transfer process), leaving a slight amount of toner not transferred.

The surface of the photosensitive drum 1Y then comes to a point where it faces the cleaning unit 2Y. At this position, the toner not transferred and remaining on the photosensitive drum 1Y is collected (cleaning process).

Finally, the surface of the photosensitive drum 1Y comes to a point where it faces the de-charger (not shown).

At this position, residual potential on the photosensitive drum 1Y is removed.

In this way, a series of the image creating processes on the photosensitive drum 1Y is complete.

The image creating processes are performed for the other image creating sections 6M, 6C, and 6K, as in the same manner as for the yellow image creating section 6Y. The laser light L is emitted based on image information from the exposing unit 7 provided below the image creating section, and illuminates the photosensitive drums of the image creating sections 6M, 6C, and 6K. Specifically, the exposing unit 7 performs scanning such that the laser light L emitted from a light source is directed to the photosensitive drums via a plurality of optical elements by rotatably driving a polygon mirror.

Subsequently, the developing process is performed and toner images of the respective colors formed on the photosensitive drums are transferred to and superimposed on the intermediate transfer belt 8. In this way, a color image is formed on the intermediate transfer belt 8.

The intermediate transfer device 15 (belt device) includes the intermediate transfer belt 8, four transfer rollers 9Y, 9M, 9C, and 9K (facing members), a driving roller 12, a tensioning roller 13, an inlet roller 14, and an intermediate transfer cleaning unit 10. The intermediate transfer belt 8 is stretched and supported by the three rollers 12 to 14, and moved endlessly in a direction indicated by an arrow of FIG. 1 according to rotational drive of the single roller 12.

The four transfer rollers 9Y, 9M, 9C, and 9K sandwich the intermediate transfer belt 8 with the photosensitive drums 1Y, 1M, 1C, and 1K, so as to form primary transfer nips. Further, a transfer voltage with a polarity opposite that of the toners (transfer bias) is applied to the transfer rollers 9Y, 9M, 9C, and 9K.

The intermediate transfer belt 8 travels in the direction indicated by the arrow, and passes the primary transfer nips of the transfer rollers 9Y, 9M, 9C, and 9K sequentially. Accordingly, the toner images of the respective colors formed on the photosensitive drums 1Y, 1M, 1C, and 1K are superimposed on the intermediate transfer belt 8, and the primary transfer is complete.

The intermediate transfer belt 8 having the color toner image transferred thereon travels to a point where it faces a secondary transfer roller 19. At this point, the driving roller 12 sandwiches the intermediate transfer belt 8 with the secondary transfer roller 19, so as to form a secondary transfer nip. The four-color toner image formed on the intermediate transfer belt 8 is transferred to a recording medium P, such as a transfer sheet, which is transported to the position of the secondary transfer nip, and toners not transferred to the recording medium P remain on the intermediate transfer belt 8.

The intermediate transfer belt 8 then comes to a point of the intermediate transfer cleaning unit 10. At this position, the toners not transferred and remaining on the intermediate transfer belt 8 are collected.

In this way, a series of the transfer process on the intermediate transfer belt 8 is complete. Structures and operations of the intermediate transfer device 15 serving as a belt device will be described later in detail referring to FIGS. 3 to 5.

The recording medium P transported to the position of the secondary transfer nip is originally fed from a paper feeder 26 provided below the image forming apparatus main body 100, and is transported through a paper feed roller 27, a pair of resist rollers 28, and the like.

Specifically, the paper feeder 26 holds a plurality of recording media P such as transfer sheets stacked on top of another. When the paper feed roller 27 is rotationally driven in a counterclockwise direction as indicated by an arrow of FIG. 1, the top recording media P is fed into a gap between the pair of resist rollers 28.

The recording medium P transported to the pair of resist rollers 28 is suspended in the nip of the resist rollers 28 having stopped its rotational drive. Further, the pair of resist rollers 28 is rotatably driven to adjust the time at which the color image on the intermediate transfer belt 8 approaches, causing the recording medium P to be transported to the secondary transfer nip. In this way, a desired color image is transferred to the recording medium P.

The recording medium P receives the color image transferred thereon at the secondary transfer nip, and is transported to the fixing unit 20. Then the recording medium P is heated and pressured by a fixing roller and a pressure roller. Accordingly, the color image transferred on the surface of the recording medium P is fixed thereto.

The recording medium P is then passed through a pair of discharging rollers 29 and discharged from the apparatus. The recording medium P thus discharged from the apparatus by the discharging rollers 29 is stacked on a stacking unit 30 one by one as an output image.

In this way, a series of image forming processes in the image forming apparatus is complete.

Referring to FIG. 2, the following describes the structure and operation of the developing unit of the image creating section in greater detail.

The developing unit 5Y includes a developing roller 51Y (developer carrying body) that faces the photosensitive drum 1Y, a doctor blade 52Y that faces the developing roller 51Y, two transporting screws 55Y provided in developer reservoirs 53Y and 54Y, a toner replenishing unit 58Y connected to the developer reservoir 54Y through an opening, and a density detecting sensor 56Y that detects density of toner in the developer. The developing roller 51Y includes an internally fixed magnet, and a sleeve that rotates around the magnet. The developer reservoirs 53Y and 54Y contain a two-component developer including carrier and toner.

The developing unit 5Y having the above structure operates in the following manner.

The sleeve of the developing roller 51Y rotates in a direction indicated by the arrow of FIG. 2. Accordingly, the developer carried on the developing roller 51Y due to electric field generated by the magnet is moved over the developing roller 51Y according to rotation of the sleeve.

The developer in the developing unit 5Y is adjusted so that the ratio of the toner in the developer (toner density) is maintained within a predetermined range. Specifically, according to depletion of the toner from the developing unit 5Y, the toner in the toner bottle 32Y is replenished to the developer reservoir 54Y through a toner transporting pipe 43 of the toner transporting unit 40Y, and the toner replenishing unit 58Y.

The toner replenished into the developer reservoir 54Y is then agitated and mixed with the developer by the two transporting screws 55Y, and circulated in the two developer reservoirs 53Y and 55Y (movement in a direction along the vertical orientation of the sheet, in FIG. 2). Further, the toner in the developer is charged by friction with the carrier, sucked to it, and carried on the developing roller 51Y together with the carrier by magnetic force generated on the developing roller 51Y.

The developer carried on the developing roller 51Y is transported in the direction indicated by the arrow of FIG. 2, and comes to a point where it faces the doctor blade 52Y. At this position, the developer on the developing roller 51Y is adjusted to have an appropriate amount, and then transported to the position of the photosensitive drum 1Y (developing area). Accordingly, the toner is sucked to the latent image on the photosensitive drum 1Y due to the electric field generated in the developing area. Further, the developer remaining on the developing roller 51Y comes to a point over the developer reservoir 53Y according to rotation of the sleeve, and is detached from the developing roller 51Y at this position.

Figure 3:
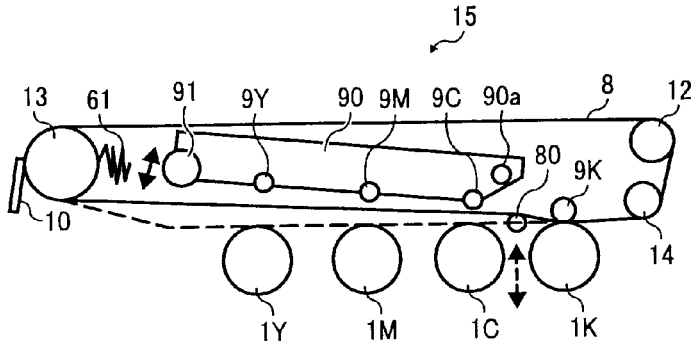
FIG. 3 is a schematic drawing of a belt device provided in the image forming apparatus of FIG. 1.
Figure 4:
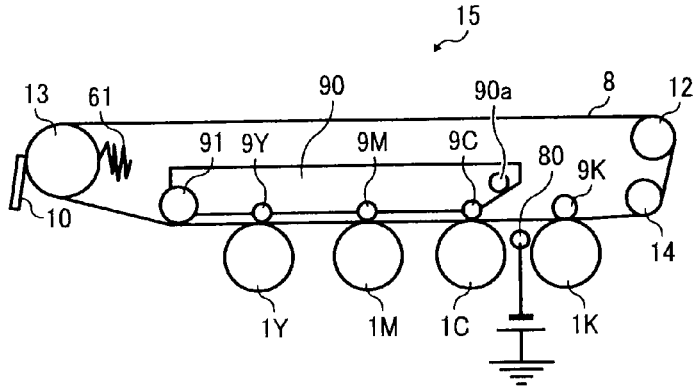
FIG. 4 is a schematic drawing of the belt device in forming a color image.

Referring to FIGS. 3 to 5, the following describes in detail the intermediate transfer device 15 (belt device) as a feature of the image forming apparatus according to the first embodiment.

FIG. 3 is a schematic drawing of the intermediate transfer device in forming a black image, and FIG. 4 is a schematic drawing of the intermediate transfer device in forming a color image.

As shown in FIGS. 3 and 4, the intermediate transfer device 15 serving as a belt device includes the intermediate transfer belt 8 as a belt member, the transfer rollers 9Y, 9M, 9C, and 9K as facing members, a holding unit 90 as a detaching unit, a push-up roller 80 as a contacting member (roller member), the driving roller 12, the tensioning roller 13 (biased toward the cleaning blade 10 by a biasing member 61), the inlet roller 14, and the intermediate cleaning blade 10.

The intermediate transfer belt 8 serving as a belt member is provided so as to face the four photosensitive drums 1Y, 1M, 1C, and 1K serving as carrying bodies (image carrying bodies) to carry the toner images of the respective colors. The intermediate transfer belt 8 is stretched and supported substantially by the three rollers (the driving roller 12, the tensioning roller 13, and the inlet roller 14).

The transfer rollers 9Y, 9M, 9C, and 9K serving as facing members respectively face the photosensitive drums 1Y, 1M, 1C, and 1K with the intermediate transfer belt 8 in between. Specifically, the transfer roller 9Y for yellow faces the photosensitive drum 1Y for yellow via the intermediate transfer belt 8, the transfer roller 9M for magenta faces the photosensitive drum 1M for magenta via the intermediate transfer belt 8, the transfer roller 9C for cyan faces the photosensitive drum 1C for cyan via the intermediate transfer belt 8, and the transfer roller 9K for black faces the photosensitive drum 1K for black via the intermediate transfer belt 8.

The holding unit 90 serving as a detaching unit brings only at least one of the four transfer rollers (facing members) 9Y, 9M, 9C, and 9K into close proximity to its corresponding photosensitive drum (carrying body), so as to detach the other transfer rollers from the other photosensitive drums.

Specifically, the holding unit 90 holds a tensioning roller 91, and the transfer rollers 9Y, 9M, and 9C for reproduction of three complementary colors. The holding unit 90 can rotatably move about a supporting shaft 90*a* (in both directions indicated by bold arrows of FIG. 3). In forming a black image (monochrome image), the holding unit 90 brings only the transfer roller 9K for black into close proximity to the photosensitive drum 1K for black, so as to detach the other transfer rollers 9Y, 9M, and 9C from the other photosensitive drums 1Y, 1M, and 1C as shown in FIG. 3. In contrast, in forming a color image, the holding unit 90 brings the four transfer rollers 9Y, 9M, 9C, and 9K into close proximity to the four photosensitive drums 1Y, 1M, 1C, and 1K as shown in FIG. 4 (during this operation, the tensioning roller serves as to stretch the intermediate transfer belt 8).

The intermediate transfer device 15 according to the first embodiment includes the push-up roller 80 serving as a contacting member. The push-up roller 80 contacts the outer circumference of the intermediate transfer belt 8 so as to further detach the three transfer rollers 9Y, 9M, and 9C from the three photosensitive drums 1Y, 1M and 1C, when the holding unit 90 detaches the three transfer rollers for color reproduction from the photosensitive drums (when forming a black image). As shown in FIG. 3, the push-up roller 80 pushes the intermediate transfer belt 8 upward in conjunction with the detaching operation of the holding unit 90 when forming a black image.

This secures sufficient space between the intermediate transfer belt 8 and the three photosensitive drums 1Y, 1M, and 1C in forming a black image, with a relatively simple structure and without increasing the apparatus size. Thus, even when the detaching operation of the holding unit 90 alone cannot secure sufficient space between the intermediate transfer belt 8 and the photosensitive drum 1C for cyan positioned close to the photosensitive drum 1K for black (that is not detached from its facing member), sufficient space can be secured between the intermediate transfer belt 8 and the photosensitive drum 1C for cyan because the push-up roller 80 pushes the intermediate transfer belt 8 upward. This arrangement reduces wear of the photosensitive drums 1Y, 1M, and 1C and the intermediate transfer belt 8, and prevents the toner adhered to the photosensitive drums 1Y, 1M, and 1C from scattering over the intermediate transfer belt 8. Further, when the photosensitive drums are mounted on or removed from the image forming apparatus main body 100, this arrangement also prevents that the photosensitive drums 1Y, 1M, and 1C contact the intermediate transfer belt 8 and either of the members is scraped.

The push-up roller 80 serving as a contacting member is a roller member made of metal material and moving detachably toward or away from the outer circumference of the intermediate transfer belt 8 (in both directions indicated by dotted arrows of FIG. 3). The push-up roller 80 is positioned, in the traveling direction of the intermediate transfer belt 8, upstream of the transfer roller 9K for black and the photosensitive drum 1K for black and downstream of the other transfer rollers 9Y, 9M, and 9C and the other photosensitive drums 1Y, 1M, and 1C. In forming a black image, this arrangement allows the push-up roller 80 to efficiently detach the other transfer rollers 9Y, 9M, and 9C from the intermediate transfer belt 8, without affecting the image carried on the intermediate transfer belt 8.

According to the first embodiment, the push-up roller 80 accepts an applied voltage (bias) with a polarity identical to that of the toners (used to form toner images on the photosensitive drums). Specifically, as shown in FIG. 4, in forming a color image, when the push-up roller 80 is pulled away from the intermediate transfer belt 8, a voltage with a negative polarity (identical to that of the toners) is applied to the push-up roller 80.

This prevents that the three-color (yellow, magenta, and cyan) toner image formed on the intermediate transfer belt 8 is statically sucked to (scattered over) the push-up roller 80 in the upstream of the push-up roller 80 (in the traveling direction of the intermediate transfer belt 8), thereby avoiding degradation of color image quality.

Figure 5A:
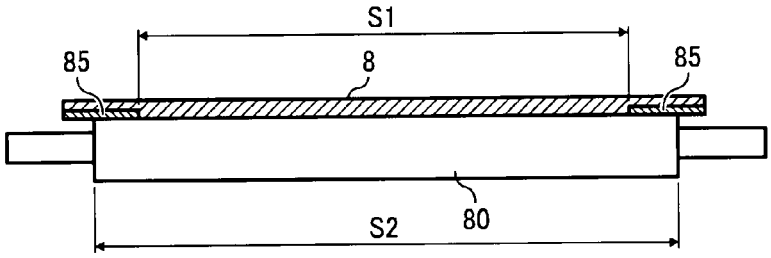
FIG. 5 is a schematic drawing of a contacting member and an intermediate transfer belt when viewed from their width side.

According to the first embodiment, as shown in FIG. 5A, tape members 85 are sealed on and circumferentially extend along both edges of the outer circumference of the intermediate transfer belt 8 (i.e., edges when viewed from its width side). The tape members 85 are made of a material, such as PET, that has a thickness of equal to or less than 0.1 millimeter and a low frictional resistance. The tape members 85 prevent cracking of the both edges of the intermediate transfer belt 8. Further, when the push-up roller 80 contacts the intermediate transfer belt 8 (in forming a black image), the both edges (edge sections) of the push-up rollers 80 in are brought into contact with the tape members 85. Specifically, a length S2 along the width side of the push-up roller 80 is set greater than a length S1 of a non-sealed region (on which the tape members 85 are not sealed) of the intermediate transfer belt 8 (S1<S2).

This arrangement prevents that the both edges (edge sections) of the push-up roller 80 scrape the circumference of the intermediate transfer belt 8 when directly contacting the intermediate transfer belt 8.

Figure 5B:
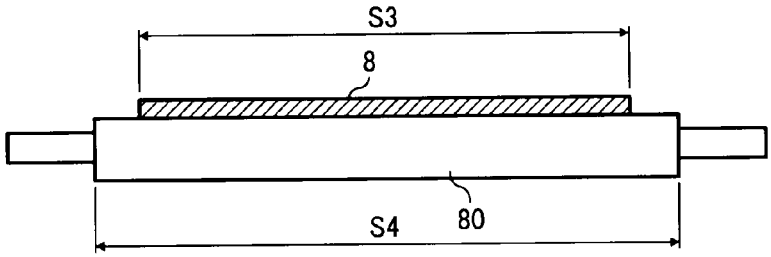

According to the first embodiment, the both edges of the push-up roller 80 contact the tape members 85. The push-up roller 80 may contact the entire portion extending across-the-width of the intermediate transfer belt 8. Specifically, as shown in FIG. 5B, the push-up roller 80 may be formed to have a width of length S4 that is greater than the length S3 of the width of the intermediate transfer belt 8 (S3<S4). This arrangement also prevents that the both edges (edge sections) of the push-up roller 80 directly contact the intermediate transfer belt 8.

As described, in the image forming apparatus of the first embodiment, from among the transfer rollers (facing members) 9Y, 9M, 9C, and 9K, the transfer rollers 9Y, 9M, and 9C exclusive of the specific transfer roller 9K are detached from the photosensitive drums (carrying bodies) 1Y, 1M, and 1C. To this end, the push-up roller (contacting member) 80 is brought into contact with the intermediate transfer belt (belt member) 8, so as to detach the intermediate transfer belt 8 from the photosensitive drums 1Y, 1M, and 1C. This secures sufficient space between the intermediate transfer belt 8 and the photosensitive drums 1Y, 1M, and 1C other than the specific photosensitive drum 1K, with a relatively simple structure and without increasing the apparatus size.

Further, according to the first embodiment, the push-up roller 80 serving as a contacting member is a component of the intermediate transfer device 15 (belt device). The push-up roller 80 may be a component of the image forming apparatus main body 100. Specifically, the push-up roller 80 may be integrated in the image forming apparatus main body 100, not in the intermediate transfer device 15. With this arrangement, the advantages achieved in the first embodiment can also be yielded.

Figure 6:
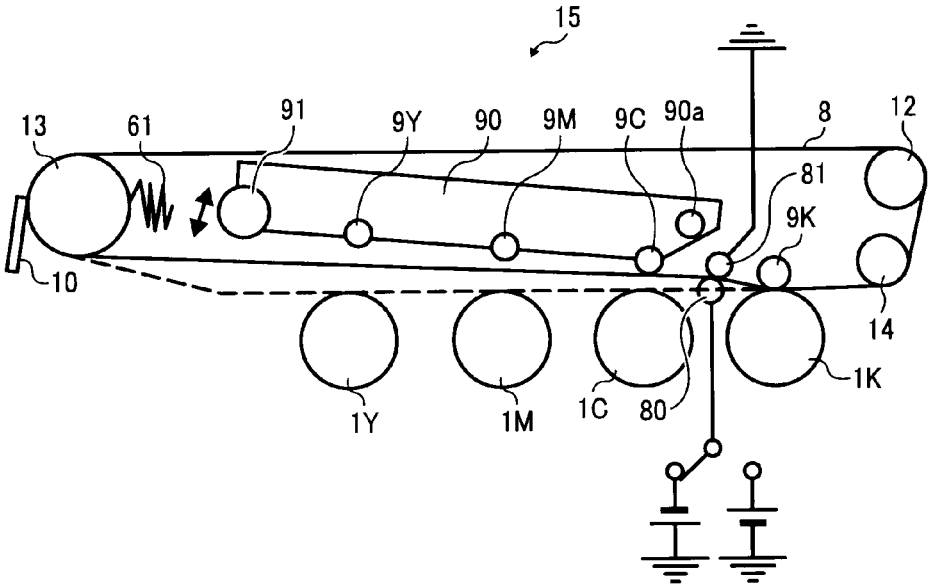
FIG. 6 is a schematic drawing of a belt device according to a second embodiment of the present invention.
Figure 7:
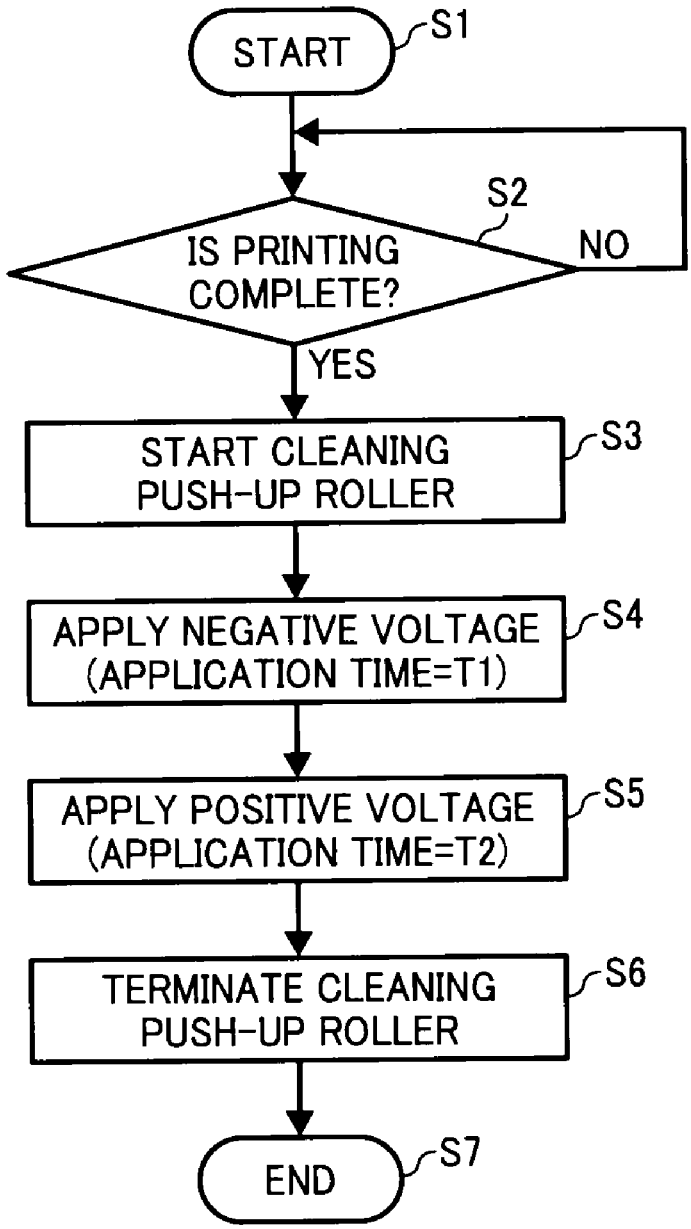
FIG. 7 is a flowchart representing timing for applying voltages to the contacting member.

Referring to FIGS. 6 and 7, a second embodiment of the present invention is described in detail.

FIG. 6 is a schematic drawing of the belt device 15 according to the second embodiment that corresponds to FIG. 3 of the first embodiment. The belt device of the second embodiment differs from that of the first embodiment in that toner adhered to the contacting member 80 is cleaned at a predetermined timing.

As shown in FIG. 6, according to the second embodiment, a facing roller 81 (grounded) is provided so as to face the push-up roller 80 (facing member) with the intermediate transfer belt 8 (belt member) in between. A predetermined voltage is applied to the push-up roller 80 at a predetermined timing, and the push-up roller 80 and the facing roller 81 are brought into contact with the intermediate transfer belt 8 (sandwich the intermediate transfer belt), so that the toner adhered to the push-up roller 80 is moved to the intermediate transfer belt 8 and thus cleaned.

Specifically, a voltage with a polarity identical to that of the toners (used to form toner images on the photosensitive drums) and a voltage with a polarity opposite that of the toners are alternately applied (biased) to the push-up roller 80. Specifically, as shown in FIG. 6, upon completion of image formation, the push-up roller 80 and the facing roller 81 are brought into contact with the intermediate transfer belt 8, and a voltage with the negative polarity and a voltage with the positive polarity are alternately applied to the push-up roller 80.

With this arrangement, the toner sufficiently charged and adhered to the push-up roller 80 is moved to the intermediate transfer belt 8 with the application of voltage having the negative polarity. Further, the toner insufficiently charged and adhered to the push-up roller 80 (oppositely-charged toner or weakly charged toner) is moved to the intermediate transfer belt 8 with the application of voltage having the positive polarity. In this way, the toner adhered to the push-up roller 80 is cleaned. As such, in forming a black image (i.e., in forming an image with the push-up roller 80 maintained in contact with the intermediate transfer belt 8), it is prevented that the toner on the push-up roller 80 is moved and the image appears to have toner particles scattered thereon.

The voltage with the negative polarity and the voltage with the positive polarity are applied to the push-up roller 80 over a sufficient time. Specifically, the push-up roller 80 rotates in a clockwise direction indicated in FIG. 6 due to the frictional resistance caused by the movement of the intermediate transfer belt 8, and each of the voltages is applied at least for a time period during which the push-up roller 80 makes one rotation while being in contact with the intermediate transfer belt 8. This arrangement ensures cleaning of the toner adhered to the push-up roller 8, i.e., the positively-charged toner and the oppositely-charged/weakly-charged toner.

The operation for cleaning the push-up roller 80 is preferably performed after an accumulated frequency (accumulated time) of image formation exceeds a predetermined value and also after completion of the series of the image forming processes (jobs). This allows the push-up roller 80 to be cleaned regularly.

Referring to FIG. 7, the cleaning operation for the push-up roller 80 is described.

After printing (image forming processing) is started (Step S1), it is determined whether a series of print jobs is complete (Step S2). As a result of the determination, if the print jobs are not complete, the processes subsequent to Step S2 are repeated.

On the contrary, if the print jobs are complete, the cleaning operation for the push-up roller 80 is started (Step S3). Accordingly, a voltage with the negative polarity is applied only for a time period T1 (Step S4), and a voltage with the positive polarity is applied only for a time period T2 (Step S5), and the cleaning operation is terminated (Step S6).

Accordingly, the flow ends (Step S7).

As described, in the second embodiment as well as in the first embodiment, the three transfer rollers 9Y, 9M, and 9C for color reproduction are detached from the photosensitive drums 1Y, 1M, and 1C by bringing the push-up roller 80 into contact with the intermediate transfer belt 8. This secures sufficient space between the intermediate transfer belt 8 and the three transfer rollers 9Y, 9M, and 9C for color reproduction, with a relatively simple structure and without increasing the apparatus size.

According to the second embodiment, after completion of the series of the image forming processes, voltages with both polarities are alternately applied to the push-up roller 80, so that the push-up roller 80 is brought into contact with the intermediate transfer belt 8.

On the contrary, before forming a black image (before starting to create an image), a voltage with the negative polarity may be applied to the push-up roller 80 to bring it into contact with the intermediate transfer belt 8. This prevents the toner stacked on the cleaning blade of the intermediate transfer cleaning unit 10 from adhering to the push-up roller 80 even when the toner drops from the cleaning blade in the beginning of image creation. In this arrangement, the push-up roller 80 may be grounded so that a voltage with the positive polarity (that is opposite the polarity of the toners) is applied to the facing roller 81.

Further, in forming a black image (during image formation), a voltage with the negative polarity may be applied to the push-up roller 80 to bring it into contact with the intermediate transfer belt 8. This reduces scattering of the toner particles when the toner image formed on the photosensitive drum 1K is transferred to the intermediate transfer belt 8.

Figure 8:
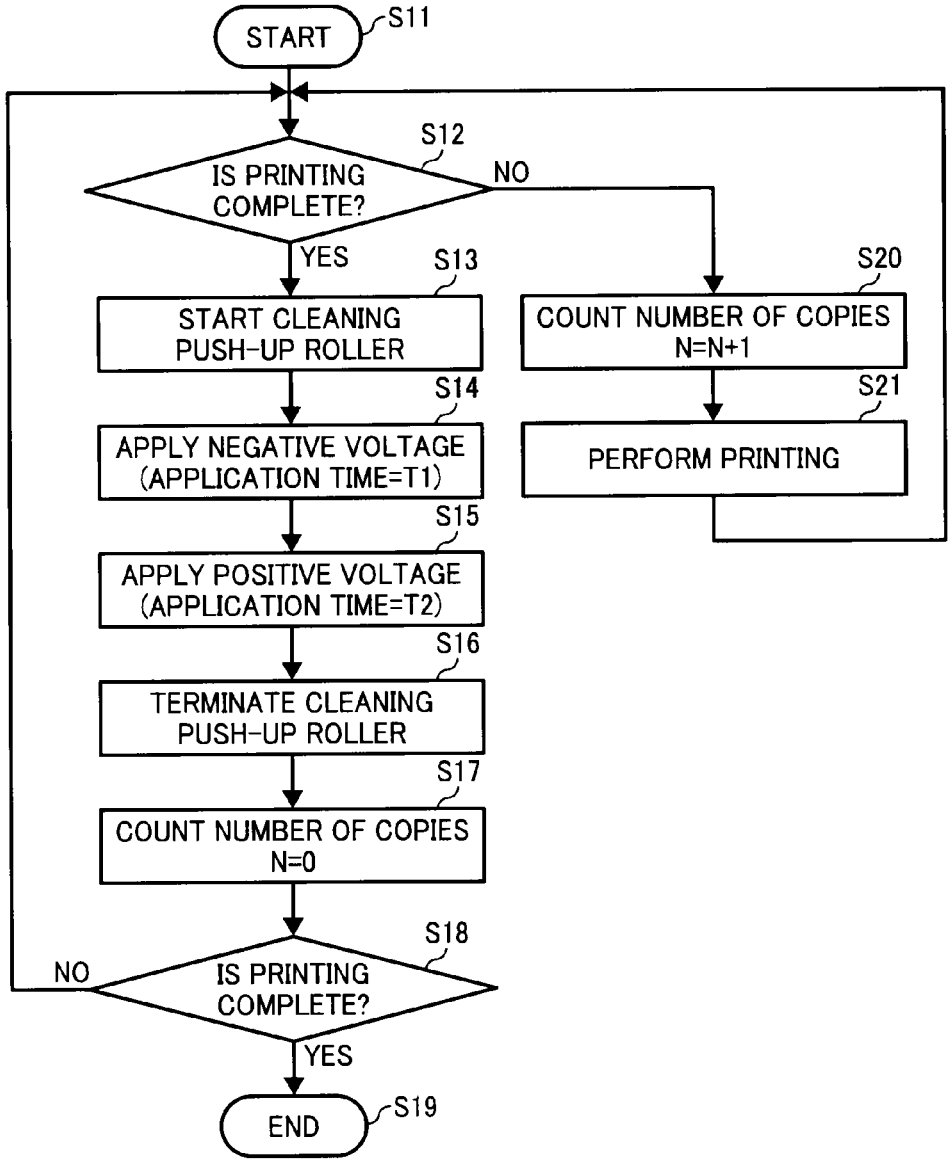
FIG. 8 is a flowchart representing timing for applying voltages to the contacting member according to a third embodiment of the present invention.

Referring to FIG. 8, a third embodiment of the present invention is described in detail.

FIG. 8 is a flowchart representing timing for applying voltages to the contacting member 80 of the belt device 15 that corresponds to FIG. 7 of the second embodiment. The belt device of the third embodiment differs from that of the second embodiment in that the toner adhered to the contacting member 80 is cleaned even while the print jobs are being performed.

As in the second embodiment, the image forming apparatus according to the third embodiment also performs the cleaning operation for the push-up roller 80 (i.e., operation for moving the toner adhered to the push-up roller 80 to the intermediate transfer belt 8).

According to the third embodiment, even when the series of the image forming processes (jobs) is not complete after an accumulated frequency (accumulated time) of image formation exceeds a predetermined value, the series of the image forming processes is stopped and the cleaning operation for the push-up roller 80 is performed. This ensures that the push-up roller 80 is cleaned even when a large volume of copies is set for continuous printing.

Referring to FIG. 8, a flow of the cleaning operation for the push-up roller 80 is described.

After printing (image forming processing) is started (Step S11), it is determined whether the series of the print jobs is complete (Step S12). As a result of the determination, if the print jobs are not complete, the number of copies is counted and added (Step S20), printing is performed (Step S21), and the processes subsequent to Step S12 are repeated.

On the contrary, if the print jobs are complete, the cleaning operation for the push-up roller 80 is started (Step S13). Accordingly, a voltage with the negative polarity is applied only for a time period T1 (Step S14), a voltage with the positive polarity is applied only for a time period T2 (Step S15), and the cleaning operation is terminated (Step S16). Thereafter, the number of copies is initialized (Step S17), and determination is made as to determine whether the print jobs are complete (Step S18).

As a result of the determination, if the print jobs are not complete, the processes subsequent to Step S12 are repeated. On the contrary, if the print jobs are complete, the flow ends (Step S19).

As described, in the third embodiment as well as in the foregoing embodiments, the three transfer rollers 9Y, 9M, and 9C for color reproduction are detached from the photosensitive drums 1Y, 1M, and 1C by bringing the push-up roller 80 into contact with the intermediate transfer belt 8. This secures sufficient space between the intermediate transfer belt 8 and the three photosensitive drums 1Y, 1M, and 1C for color reproduction, with a relatively simple structure and without increasing the apparatus size.

Figure 9:
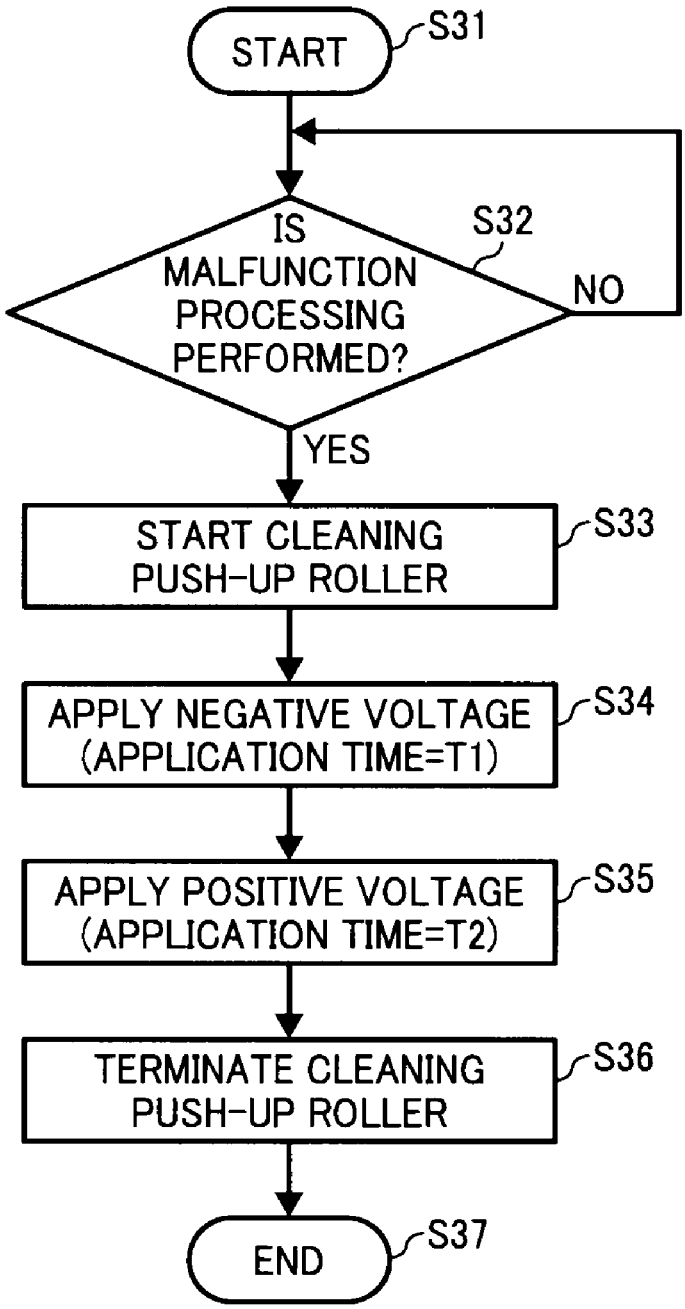
FIG. 9 is a flowchart representing timing for applying voltages to the contacting member according to a fourth embodiment of the present invention.

Referring to FIG. 9, a fourth embodiment of the present invention is described in detail.

FIG. 9 is a flowchart representing timing for applying voltages to the contacting member 80 of the belt device 15 according to the fourth embodiment that corresponds to FIG. 7 of the second embodiment. The belt device of the fourth embodiment differs from that of the second embodiment in that toner adhered to the contacting member 80 is cleaned when malfunction processing is performed.

As in the second embodiment, the image forming apparatus according to the fourth embodiment also performs the cleaning operation for the push-up roller 80.

According to the fourth embodiment, the cleaning operation for the push-up roller 80 is performed after eliminating a malfunction detected in the image forming apparatus main body 100. This ensures that the push-up roller 80 is cleaned even when the toner (toner image) is adhered to the intermediate transfer belt 8 due to the malfunction occurring in the apparatus and the push-up roller 80 remains uncleaned. Examples of such malfunction in the apparatus include jam of recording media, and various kinds of malfunctions requiring maintenance personnel.

Referring to FIG. 9, a flow of the cleaning operation for the push-up roller 80 is described.

After printing (image forming processing) is started (Step S31), it is determined whether malfunction processing in the apparatus is complete (Step S32). As a result of the determination, if the malfunction processing is not complete, the processes subsequent to Step S32 are repeated.

On the contrary, if the malfunction processing is complete, the cleaning operation for the push-up roller 80 is started (Step S33). Accordingly, a voltage with the negative polarity is applied only for a time period T1 (Step S34), a voltage with the positive polarity is applied only for a time period T2 (Step S35), and the cleaning operation is terminated (Step S36).

Accordingly, the flow ends (Step S37).

As described, in the fourth embodiment as well as in the foregoing embodiments, the three transfer rollers 9Y, 9M, and 9C for color reproduction are detached from the photosensitive drums 1Y, 1M, and 1C by bringing the push-up roller 80 into contact with the intermediate transfer belt 8. This secures sufficient space between the intermediate transfer belt 8 and the three photosensitive drums 1Y, 1M, and 1C for color reproduction, with a relatively simple structure and without increasing the apparatus size.

Figure 10:
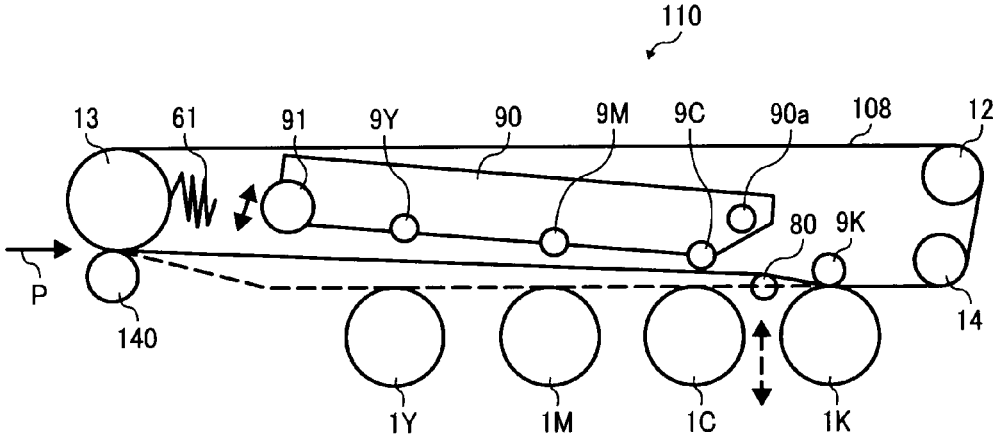
FIG. 10 is a schematic drawing of a belt device according to a fifth embodiment of the present invention.

Referring to FIG. 10, a fifth embodiment of the present invention is described in detail.

FIG. 10 is a schematic drawing of a belt device according to the fifth embodiment. In the fifth embodiment, a transfer conveyor belt is used as a belt member, whereas in the foregoing embodiments, an intermediate transfer belt is used as a belt member. Thus, the fifth embodiment differs from the foregoing embodiments in this regard.

As shown in FIG. 10, a belt device 110 according to the fifth embodiment uses a transfer conveyor belt 108 as a belt member.

The belt device 110 includes the transfer conveyor belt 108, the four transfer rollers 9Y, 9M, 9C, and 9K (facing members), the holding unit 90 (detaching unit), the push-up roller 80 (contacting member), the driving roller 12, the tensioning roller 13, and the inlet roller 14.

The transfer conveyor belt 108 serving as a belt member is provided so as to face the four photosensitive drums 1Y, 1M, 1C, and 1K (image carrying bodies). The four transfer rollers 9Y, 9M, 9C, and 9K respectively face the photosensitive drums 1Y, 1M, 1C, and 1K with the transfer conveyor belt 108 in between.

The transfer conveyor belt 108 transports the recording medium P (in a direction indicated by an arrow of FIG. 10), so that toner images formed on the photosensitive drums 1Y, 1M, 1C, and 1K are transferred to and superimposed on the recording medium P (the secondary transfer is not performed, unlike the first embodiment).

The holding unit 90 serving as the detaching unit and the push-up roller 80 serving as the contacting member are the same as those described in the foregoing embodiments in regard to their structures and operations. Specifically, in forming a black image, while the holding unit 90 performs the detaching operation, the push-up roller 80 contacts the transfer conveyor belt 108 and pushes it upward (as shown in FIG. 10). In contrast, in forming a color image, the holding unit 90 does not perform the detaching operation and the push-up roller 80 is pulled away from the transfer conveyor belt 108, allowing all of the four photosensitive drums 1Y, 1M, 1C, and 1K to be brought into contact with the transfer conveyor belt 108.

As described, in the image forming apparatus according to the fifth embodiment, from among the transfer rollers (facing members) 9Y, 9M, 9C, and 9K, the transfer rollers 9Y, 9M, and 9C other than the specific transfer roller 9K are detached from the photosensitive drums (carrying bodies) 1Y, 1M, and 1C. To this end, the push-up roller (contacting member) 80 is brought into contact with the transfer conveyor belt (belt member) 108, so that the transfer conveyor belt 108 is detached from the photosensitive drums 1Y, 1M, and 1C. This secures sufficient space between the transfer conveyor belt 108 and the photosensitive drums 1Y, 1M, and 1C other than the specific photosensitive drum 1K, with a relatively simple structure and without increasing the apparatus size.

Figure 11:
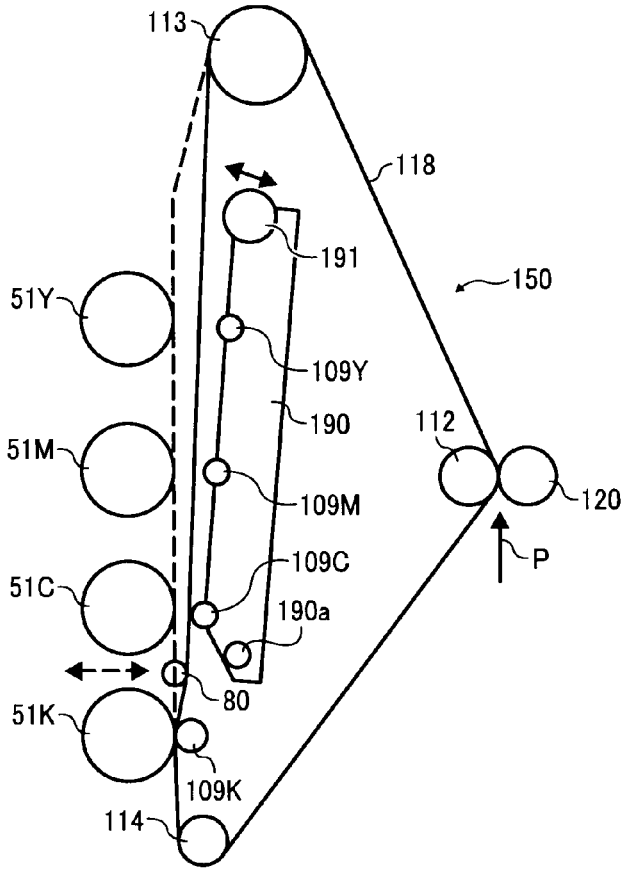
FIG. 11 is a schematic drawing of a belt device according to a sixth embodiment of the present invention.

Referring to FIG. 11, a sixth embodiment of the present invention is described in detail.

FIG. 11 is a schematic drawing of a belt device according to the sixth embodiment. In the sixth embodiment, a photoreceptor belt is used as a belt member, whereas in the first embodiment, an intermediate transfer belt is used as a belt member. Thus, the sixth embodiment differs from the first embodiment in this regard.

As shown in FIG. 11, a belt device 150 according to the sixth embodiment uses a photoreceptor belt 118 as a belt member.

The belt device 150 includes the photoreceptor belt 118, four facing members 109Y, 109M, 109C, and 109K of roller type, a holding unit 190 (detaching unit) that rotatably moves about a supporting shaft 190*a*, the push-up roller 80 (contacting member), a driving roller 112, a tensioning roller 113, and an inlet roller 114.

The photoreceptor belt 118 serving as a belt member is provided so as to face four carrying bodies, i.e., developing rollers 51Y, 51M, 51C, and 51K (developer carrying bodies). The four facing members 109Y, 109M, 109C, and 109K respectively face the developing rollers 51Y, 51M, 51C, and 51K with the photoreceptor belt 118 in between. With respect to the developing rollers 51Y, 51M, 51C, and 51K, a charger and an exposing unit (both not shown) are positioned upstream and a cleaning unit (not shown) is positioned downstream in the traveling direction of the photoreceptor belt 118.

On the photoreceptor belt 118, toner images are superimposed that are toned corresponding to the developers carried on the developing rollers 51Y, 51M, 51C, and 51K. The resulting toner image on the photoreceptor belt 118 is then transferred to the recording medium P at the position of the transfer roller 120.

The holding unit 190 serving as the detaching unit and the push-up roller 80 serving as the contacting member are the same as those described in the foregoing embodiments in regard to their structures and operations. Specifically, in forming a black image, while the holding unit 190 performs the detaching operation, the push-up roller 80 contacts the photoreceptor belt 118 so as to push the photoreceptor belt 118 upward (as shown in FIG. 11). In contrast, in forming a color image, the holding unit 190 does not perform the detaching operation and the push-up roller 80 is pulled away from the photoreceptor belt 118, allowing all of the four developing rollers 51Y, 51M, 51C, and 51K to be brought into contact with the photoreceptor belt 118 (during this time, a tensioning roller 191 stretches the photoreceptor belt 118).

As described, in the image forming apparatus according to the sixth embodiment, from among the facing members 109Y, 109M, 109C, and 109K, the facing members 109Y, 109M, and 109C other than the specific facing member 109K are detached from the developing rollers (carrying bodies) 51Y, 51M, and 51C. To this end, the push-up roller (contacting member) 80 is brought into contact with the photoreceptor belt (belt member) 118, so that the photoreceptor belt 118 is detached from the developing rollers 51Y, 51M, and 51C. This secures sufficient space between the photoreceptor belt 118 and the developing rollers 51Y, 51M, and 51C other than the specific developing roller 51K, with a relatively simple structure and without increasing the apparatus size.

It is apparent that the present invention is not limited to the foregoing embodiments that encompass other modifications not described in the embodiments and may be modified in various ways as necessary within the scope of the technical idea of the invention. Further, the number, position, and shape of the components are not limited to those described in the embodiments and may be modified preferably to practice the present invention.

According to some aspects of the present invention, from among a plurality of facing members, the facing members exclusive of a specific one are detached from carrying bodies. To this end, a contacting member is brought into contact with a belt member, so that the other carrying bodies are detached from the belt member. This allows a belt device and an image forming apparatus to be provided that secure sufficient space between the belt member and the carrying bodies other than the specific carrying body, with a relatively simple structure and without increasing the apparatus size.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A belt device, comprising:

a belt member that faces a plurality of carrying bodies that respectively carry toner images or developers;

a plurality of facing members that respectively faces the plurality of carrying bodies through the belt member;

a detaching unit that brings at least one of the facing members to face a corresponding carrying body and removes other facing members away from other carrying bodies; and a contacting member that contacts the belt member to detach the belt member from the other carrying bodies when the detaching unit removes the other facing members away from the other carrying bodies, wherein the contacting member is a roller member that detachably moves with respect to an outer circumference of the belt member, the roller member being positioned at an upstream side of the facing member for black and the carrying body for black and a downstream side of the other facing members and the other carrying bodies in a traveling direction of the belt member, wherein when forming a black image, the detaching unit brings a facing member for black to face a carrying body for black and detaches the other facing members from the other carrying bodies, and when forming a color image, the detaching unit brings all the facing members to face respective carrying bodies.

2. The belt device according to claim 1, wherein the belt member includes tape members provided on both edges of the outer circumference in a width direction, and the roller member contacts the belt member such that both edges of the roller member contact the tape members.

3. The belt device according to claim 1, wherein the roller member contacts an entire portion of the belt member in a width direction.

4. A belt device comprising:

a belt member that faces a plurality of carrying bodies that respectively carry toner images or developers;

a plurality of facing members that respectively faces the plurality of carrying bodies through the belt member;

a detaching unit that brings at least one of the facing members to face a corresponding carrying body and removes other facing members away from other carrying bodies; and a contacting member that contacts the belt member to detach the belt member from the other carrying bodies when the detaching unit detaches the other facing members from the other carrying bodies, wherein a voltage with a polarity identical to a polarity of toners of the toner images or developers carried on the carrying bodies is applied to the contacting member.

5. The belt device according to claim 1, wherein a predetermined voltage is applied to the contacting member to cause toners adhered to the contacting member to move to the belt member.

6. The belt device according to claim 5, wherein voltages with polarities identical to and opposite to the polarity of the toners of the toner images or developers carried on the carrying bodies are alternately applied the contacting member.

7. The belt device according to claim 6, wherein the contacting member is a rotatably movable roller member that detachably moves with respect to the outer circumference of the belt member, and each of the voltages is applied for a time during which the roller member makes at least one rotation.

8. The belt device according to claim 5, wherein the toner adhered to the contacting member is moved to the belt member after an accumulated frequency or an accumulated time of image formation exceeds a predetermined value and after a series of image forming processes is complete.

9. The belt device according to claim 5, wherein, even when a series of image forming processes is not complete after an accumulated frequency or an accumulated time of image formation exceeds a predetermined value, the series of image forming processes is stopped and the toner adhered to the contacting member is moved to the belt member.

10. The belt device according to claim 5, wherein the toner adhered to the contacting member is moved to the belt member after a malfunction detected in an image forming apparatus main body is eliminated.

11. The belt device according to claim 1, further comprising a facing roller that faces the contacting member via the belt member, wherein a voltage with a polarity opposite to a polarity of toners of the toner images or developers carried on the carrying bodies is applied to the facing roller.

12. The belt device according to claim 1, wherein the detaching unit rotates a tensioning roller stretching an intermediate transfer belt and a holding unit holding the other facing members centering on a supporting shaft.

13. The belt device according to claim 1, wherein the carrying bodies are image carrying bodies that carry the toner images, and the belt member is an intermediate transfer belt to which the toner images carried on the image carrying bodies are transferred.

14. The belt device according to claim 1, wherein the carrying bodies are image carrying bodies that carry the toner images, and the belt member is a transfer conveyor belt that transports a recording medium and transfers the toner images carried on the image carrying bodies to the recording medium.

15. The belt device according to claim 13, wherein the facing members are transfer rollers.

16. The belt device according to claim 1, wherein the carrying bodies are developer carrying bodies that carry the developers, and the belt member is a photoreceptor belt on which the toner images are formed with the developers carried on the developer carrying bodies.

17. An image forming apparatus, comprising:

a belt member that faces a plurality of carrying bodies that respectively carry toner images or developers;

a plurality of facing members that respectively faces the plurality of carrying bodies through the belt member;

a detaching unit that brings at least one of the facing members to face a corresponding carrying body and removes other facing members away from other carrying bodies; and a contacting member that contacts the belt member to detach the belt member from the other carrying bodies when the detaching unit removes the other facing members away from the other carrying bodies, wherein the contacting member is a roller member that detachably moves with respect to an outer circumference of the belt member, and the roller member is positioned at an upstream side of the facing member for black and the carrying body for black and a downstream side of the other facing members and the other carrying bodies in a traveling direction of the belt member.

wherein when forming a black image, the detaching unit brings a facing member for black to face a carrying body for black and detaches the other facing members from the other carrying bodies, and when forming a color image, the detaching unit brings all the facing members to face respective carrying bodies.

18. The image forming apparatus according to claim 17, wherein the belt member includes tape members along both outer edges of the belt member such that the contacting member contacts at least a portion of the tape members when detaching the belt member from the other carrying bodies.

* * * * *